United States Patent [19]

Bolduc

[11] Patent Number: 4,813,189

[45] Date of Patent: Mar. 21, 1989

[54] SANDING APPARATUS

[76] Inventor: Lee R. Bolduc, 6416 Gainsborough Dr., Raleigh, N.C. 67612

[21] Appl. No.: 170,015

[22] Filed: Mar. 18, 1988

[51] Int. Cl.[4] ..... B24D 9/02

[52] U.S. Cl. ..... 51/372; 51/381; 51/390; 51/391

[58] Field of Search ..... 51/391, 381, 372, 389, 51/390, 358

[56] References Cited

U.S. PATENT DOCUMENTS 3,063,208 11/1962 Bell et al. ..... 51/391

*Primary Examiner*—Frederick R. Schmidt
*Assistant Examiner*—Maurina Rachuba
*Attorney, Agent, or Firm*—Burd, Bartz & Gutenkauf

[57] ABSTRACT

A sanding tool has a flat rectangular rigid base surrounded with an endless belt carrying abrasive materials. A transverse bar movably mounted on the base engages one end of the belt. A nut mounted on the base accommodates a threaded rod which engages the bar to hold the belt tight on the base.

15 Claims, 1 Drawing Sheet

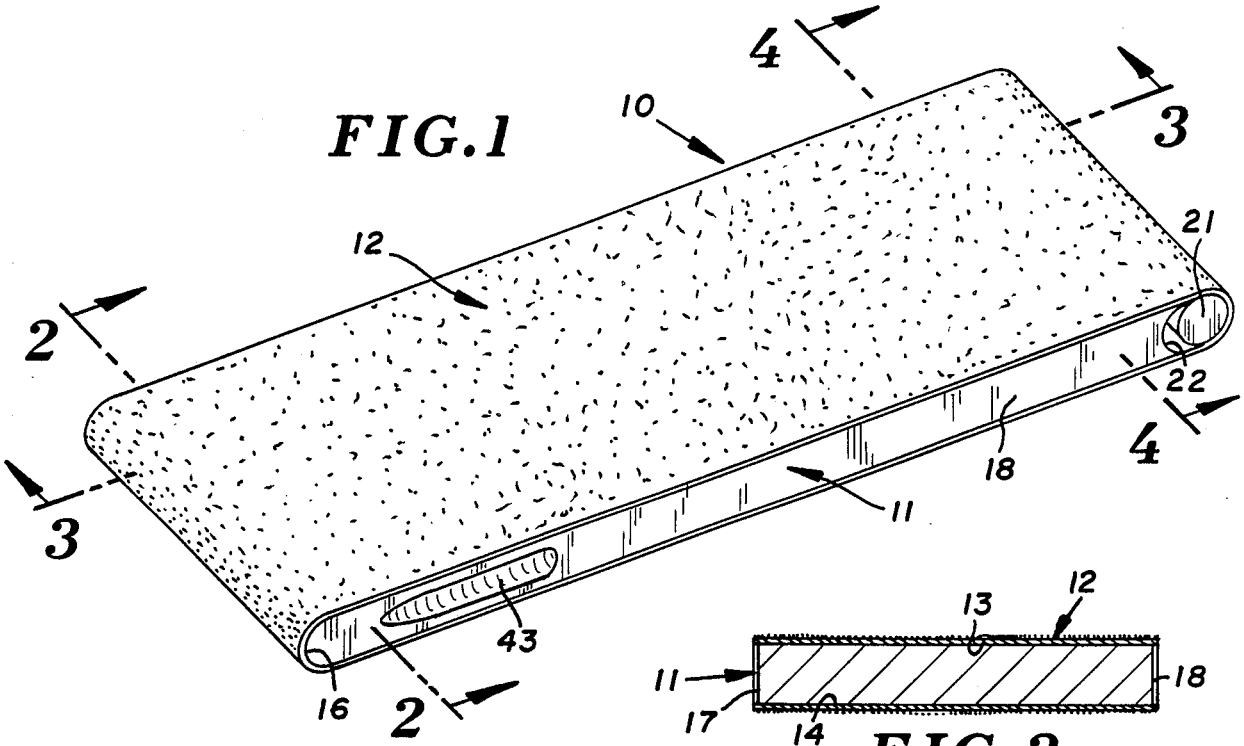
FIG.1
FIG.2
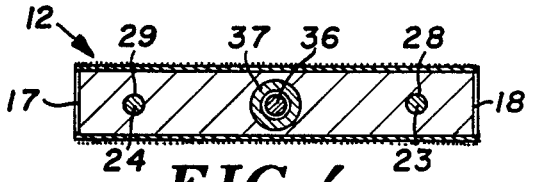
FIG.4
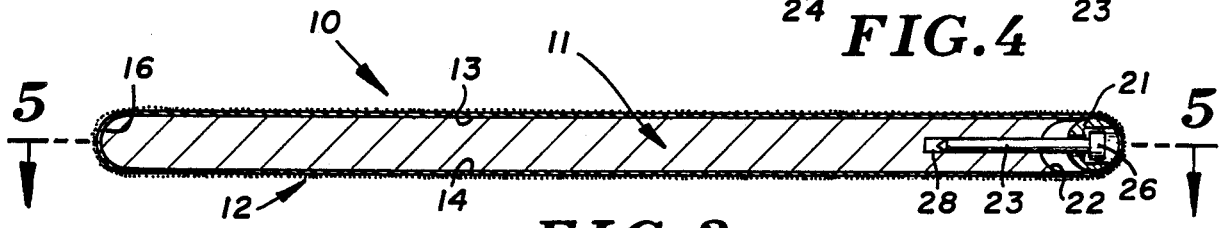
FIG.3
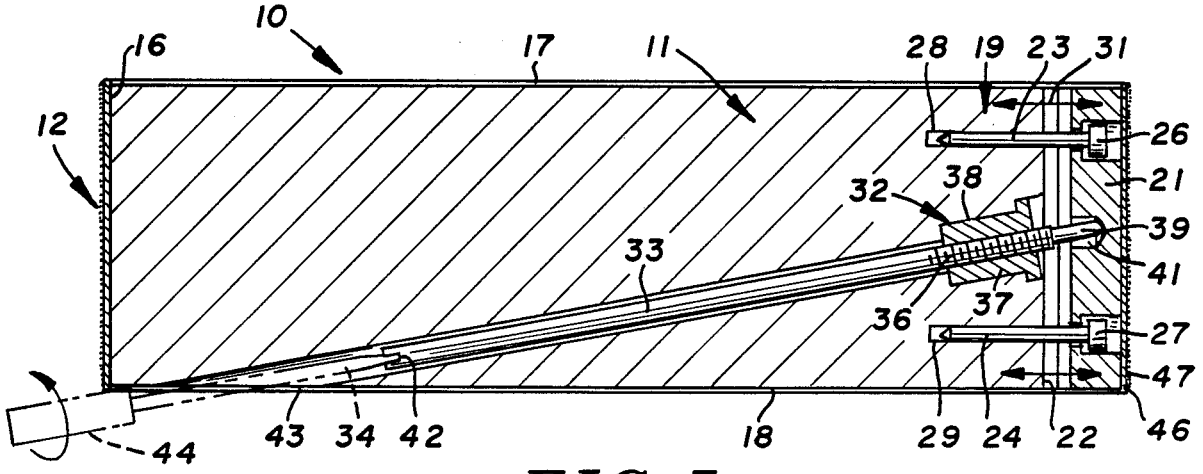
FIG.5

SANDING APPARATUS

FIELD OF INVENTION

This invention elates to a manual sanding apparatus for removing material from surfaces of a work piece.

BACKGROUND OF INVENTION

Prior sanding devices have used sheets of paper coated with abrasive material to smooth and sand various surfaces made of wood, metal, plastic, painted surfaces and the like. A representative prior sanding device includes a rectangular body having a generally flat bottom. A handle attached to the top of the body is used to grip and control the motion of the device. Fastening structures are used to releasably hold a rectangular strip of abrasive or sand paper in a tight-fit relation with the bottom surface of the body. The fastening structures include a pair of rollers located adjacent the ends of the body. Opposite ends of the strip of sand paper are wrapped around the rollers until the strip tightly engages the bottom surface of the body. Other fastenings structures, such as clamps and metal spikes, are also used to hold the strip of sand paper on the body.

The prior sanding devices have had many disadvantages and difficulties. Often the fastening structures fail to retain the strip of sand paper when excessive pressure is applied to the sanding device. The sand paper tends to wear out quickly and rip and must be replaced. Also, replacement of the sand paper on the device is cumbersome and commonly time consuming. Endless belt type abrasive bands must be cut into strips to be used with these sanding devices.

SUMMARY OF INVENTION

The invention is directed to a manually movable sanding apparatus having a base accommodating an endless sanding belt. An actuator mounted on the base is used to hold the belt in the tension on the base. The actuator can be released whereby the belt can be removed and replaced with a new sanding belt.

The sanding apparatus has a generally rectangular rigid base having substantially flat opposite and continuous surfaces. One end of the base has a convex semicircular shape. The other end of the base has a concave recess. A cylindrical bar is located adjacent the concave recess. A pair of guide pins extended through holes in the bar are secured to the base to linearly guide the bar relative to the concave end of the base. An endless belt having an outer abrasive surface is disposed about the base. One end of the belt is turned about the convex end of base. The opposite end of the belt is located about the cylindrical bar. An actuator cooperates with the base and bar to move the bar away from the base to hold the belt in tension on the base and bar. The opposite sides of the belt are located in flat surface engagement with the flat surfaces of the base. The belt has as width that is slightly greater than the width of the base so that the longitudinal corners of the base are protected by the belt and do not engage the work piece. The actuator comprises an elongated rod disposed in an angular passage in the base. One end of the passage is open to the side of the base to facilitate the entrance of a tool to rotate the rod. The opposite end of the rod is threaded through a nut mounted on the base and extends into a recess in the central portion of the bar. The bar is rotated in one direction to move the bar away from the end of the base. Rotation of the rod in the opposite direction releases the force of the rod on the bar so that the bar can freely move toward the base. This relieves the tension on the endless belt so that the belt can be removed from the base and replaced with a new belt. The actuator is confined within the base so that it does not interfere with the operation and use of the sanding apparatus.

The sanding apparatus is convenient to use, simple in construction, and provides for manual utility of a power sanding belt to achieve a sanding or braiding activity on a work piece, such as wood, metal, plastic, painted surfaces and the like. The flat surfaces of the belt can be used in sanding operation as well as the rounded ends. The flat surfaces of the belt are ideal for removing high spots on a work piece and for outside corner sanding. The belt is positioned a short distance from the palm of the user's hand giving the apparatus a low center of gravity. This allows the apparatus to be comfortably held in the proper position during operation. High quality belt sand paper can be used for greater resistance to tarring and stretching of the belt. It also permits greater belt tension. The tension of the belt increases control and handling of the sanding apparatus.

DESCRIPTION OF DRAWING

FIG. 1 is a perspective view of the sanding apparatus of the invention;

FIG. 2 is a sectional view taken along the line 2—2 of FIG. 1;

FIG. 3 is a sectional view taken along the line 3—3 of FIG. 1;

FIG. 4 is a sectional view taken along the line 4—4 of FIG. 1; and

FIG. 5 is a sectional view taken along the line 5—5 of FIG. 3.

DESCRIPTION OF PREFERRED EMBODIMENT

Referring to the drawing there is shown in FIG. 1 the sanding apparatus of the invention indicated generally at 10 usable as a hand sanding tool for removing material from surfaces that are flat and contoured by moving the sanding apparatus over the work piece or alternatively moving the work piece on the sanding apparatus. Sanding apparatus 10 has a generally rectangular rigid base indicated generally at 11 supporting an endless belt indicated generally at 12 having abrasive material on the outer surface thereof. Base 11 has a flat top surface 13 laterally spaced from a flat bottom surface 14. The surfaces 13 and 14 join at a semi-cylindrical end 16 and at a concave end 22. The opposite sides 17 and 18 of base 11 are flat, continuous, and parallel to each other. Base 11 is a flat wood member having smooth flat top and bottom surfaces 13 and 14 and smooth flat sides 17 and 18. Other materials, as rigid plastic, hardboard, metal, and the like can be used to make base 11. The base can have convex curved surfaces or angularly disposed surfaces to support the sanding belt 12.

Endless belt 12 is located around base 11 in surface engagement with top and bottom surfaces 13 and 14 whereby surfaces 13 and 14 provide a backing or support for the belt 12. Belt 12 has a width slightly larger than the width of base 11 and a length that is longer than the length of base 11. For example, the width of base 11 for a three inch wide belt is one thirty second of an inch less than three inches so the longitudinal side corners of the base are conered by the belt. This protects the corners of the base and prevents the base from engaging the work piece. Belt 12 is a conventional endless sanding belt having a continuous abrasive surface. The web is a continuous band or ring of flexible material of paper, plastic, cloth and the like. The abrasive surface can be very fine to coarse grit bonded to the web. Belt 12 can be a continuous web of emery cloth. The abrasive material can be aluminum oxide having grit sizes: fine 120, medium 80, coarse 50, or extra coarse 40. Sanding belts having widths of 3 and 4 inches are sold by 3M Hardware Products, St. Paul, Minn. 55133. For example, a cloth belt impregnated with heat resistant resin adhesive to fix the abrasive thereto can be used with base 11. The belts vary in length from 16 to 24 inches. Other size sanding belts can be used dependent upon the width and length of base 11.

Belt 12 is retained on base 11 with a belt tensioning mechanism indicated generally at 19 in FIG. 5. Mechanism 19 has a transverse cylindrical bar 21 located opposite the concave end 22 of base 11. A pair of longitudinally directed guide pins 23 and 24 are located in counter sunk traverse holes 26 and 27 in bar 21. As shown in FIG. 5, pins 23 and 24 extend through holes 26 and 27 located in opposite end portions of bar 21. Pins 23 and 24 have enlarged heads located in the large ends of holes 26 and 27 in bar 21 to allow bar 21 to have limited guided longitudinal movement relative to end 22 of base 11. Other structures can be used to secure pins 23 and 24 to bar 21. Base 11 has a pair of longitudinal bores 28 and 29 aligned with pins 23 and 24. As shown in FIG. 5, pins 23 and 24 project with a tight fit into bores 28 and 29. Bores 28 and 29 have diameters that are slightly smaller than the diameters of pins 23 and 24 so that the pins do not longitudinally move in bores 28 and 29 thereby retain bar 21 on base 11. Pins 23 and 24 can be provided with threads and turned into bores 28 and 29. The heads of pins 23 and 24 are longitudinally spaced from end 22 of base 11 to allow bar 21 to have movement in the direction of the longitudinal plane of base 11.

The movement of bar 21 is controlled with an actuator indicated generally at 32. Actuator 32 comprises an elongated control rod 33 that is located in a passage 34 extended angularly through the base 11. Passage 34 extends from approximately the middle portion of the convex end 22 to side 18 adjacent end 16. The outer end of bore 34 is open at 43 to provide access to rod 33. Rod 33 has a threaded end portion 36 that is threaded into a nut 37. Nut 37 is located in a counterbore 38 open to convex end 22. Rod 33 has a forwardly directed finger 39 that projects into a recess 41 in bar 21 midway between pins 23 and 24. The read end of rod 33 has a slot 42 that faces toward the end 43. A screw driver 44 or similar tool is inserted through open end 43 and into slot 42 to facilitate the rotation of rod 33 and thereby move bar 21 relative to the end of base 11. The rear end of rod 33 can have crossed recesses or slots to accommodate a Phillips head screw driver.

In use, screw driver 44 is turned to rotate rod 33 to move the finger 39 into base 11. This releases the pushing force on the bar 21 allowing the bar 21 to move into the concave recess end 22 of base 11. The endless sanding belt 12 having a width and length complementary to the base 11. The belt is telescoped over the base 11 with opposite ends of the belt engaging the convex end 16 of base 11 and the transverse bar 21. Screw driver 44 is then used to turn rod 33 relative to the nut 37. This moves the finger 39 in an outward direction applying tension on belt 12. The bar 21 is guided by the guide pins 23 and 24 which maintains the bar 21 in transverse alignment with the end of base 11. The rod 33 maintains the belt under tension. The opposite sides or runs of the belt are located in flat engagement with the base surfaces 13 and 14. The opposite side edges of the belt extend a slight distance outwardly from the opposite side 17 and 18 of base 11. The belt 12 protects the longitudinal corners of base 11 and prevents the corners from contacting the work piece in use.

Endless belt 12 has a flexible endless web 46 carrying a coating of abrasive material 47. The abrasive material 47 can be from extra fine to coarse. For example, grit size 120 to 40. Web 46 can be a ring of paper, metal, plastic, or cloth. The belt can be an emery cloth. Belt 12 is a commercial sanding belt commonly used on belt sanders. An industrial grade sanding belt having an aluminum oxide abrasive can be used for wood, metal, plastic, and painted surfaces.

An example of sanding apparatus 10 is as follows: base 11 is a generally rectangular flat piece of wood having a length of 9 11/16 inches, a width of 2 31/32 inches, and a thickness of ½ inch. Cylindrical bar 21 has a ½ inch diameter and a width the same as the width of base 11. Belt 12 is a conventional 3 inch by 21 inch sanding belt having aluminum oxide grit. The size of the grit can vary in accordance with the sanding requirements. As shown in FIGS. 2, 4, and 5, the width of belt 12 is slightly larger than the width of base 11 to preclude the abrading and wearing of the corners of the base 11. The above detailed embodiment of the sanding apparatus is given by way of example as other sizes and materials of the base and belt can be used for the sanding apparatus of the invention.

In use, screw driver 44 is used to release the pushing force of the rod 33 on bar 21. This allows bar 21 to move relative to guide pins 23 and 24 toward the concave recess end 22 of base 11. Endless belt 12 is slipped around base 11 with the opposite ends of the belt trained about convex curved end 16 and cylindrical bar 21. Belt 12 is a conventional power sanding belt having a width and length selected to accommodate the width and length of base 11. Screw driver 44 is used to rotate rod 33. Rod 33 is threaded out of nut 37 to move the bar 21 away from convex end 22 of the base. Rod 33 is guided on pins 23 and 24 and applies a tightening force on endless belt 12 holding the belt in tight mounted or tension relation about base 11. The upper or lower portions or runs of belt 11 are located in tight continuous surface relationship relative to the opposite flat and continuous sides of base 11.

The belt 12 can be rotated relative to base 11 by loosening the rod 33 with screw driver 44. Belt 12 can be moved in a circumferential direction to locate another portion of the sanding material adjacent the opposite flat surfaces of base 11. Screw driver 44 is then used to turn rod 33 in a direction to tighten the bar 21 to hold the belt 12 in its new tight position on base 11. Belt 12 can be replaced with a new belt by merely releasing rod 33 to relieve the holding force of the bar 21. The new belt is then slipped over base 11 about its convex end 16 and bar 21 on belt 12. Rod 33 is then rotated to move bar 21 in an outward direction to tighten belt 12 on base 11 and bar 21.

The user of the belt grips the opposite sides 17 and 18 of the base with the fingers and thumb. The sanding apparatus can be then manually moved over the surface to be sanded. The two hands can be used to grip base 11 to facilitate the movement and exert additional sanding force on the work piece. The flat surfaces of belt 12 are used for removing high spots on the work piece and for outside corner sanding. The belt 12 is located approximately ½ inch from the palm of the user's hand to give the sanding apparatus a low center of gravity. This allows the user to comfortably hold the apparatus 10 in the proper position during the sanding operation. Also, the tension of belt 12 around base 11 enhances control and handling of the sanding apparatus 10. High quality belt sand paper can be used with apparatus 10. This increases resistance to tarring and stretching of the belt 12 and permits greater belt tension.

While there has been shown and described an embodiment of the sanding apparatus of the invention, it is understood that changes in the structure, size, materials, and parts of the base and sanding belt may be made by those skilled in the art. The invention is defined in the following claims.

I claim:

1. A sanding apparatus comprising: a generally rectangular rigid base having substantially flat opposite sides, and opposite ends, a bar located adjacent one end of the base, guide means cooperating with the bar and base locating the bar transversely across one of the base, said guide means comprising laterally spaced first and second pin means secured to said one end of the base, said bar having holes accommodating said pin means whereby said pin means retain the bar adjacent said one end of the base and allow the bar limited lateral movement relative to the base, endless belt means having an outer abrasive surface located around the base and bar, said belt means having portions located in surface engagement with the opposite sides of the base, and actuator means for moving the bar relative to the base to hold the belt means in tension on the base and bar, said actuator means comprising rod means movably mounted on the base and engageable with a mid portion of the bar between said first and second pin means, and means to move said rod means and bar to apply tension to said belt means and hold said belt means in tension.

2. The base of claim 1 wherein: said belt means has a width greater than the width of the base and bar.

3. The apparatus of claim 1 wherein: each pin means has an enlarged head, said bar having counter sunk holes for the pin means and head whereby the heads of the pin means limit movement of the bar away from the one end of the base.

4. The apparatus of claim 1 wherein: one end of the base has a concave transverse recess, and the other end of the base has a transverse convex shape.

5. A sanding apparatus comprising: a generally rectangular rigid base having substantially flat opposite sides, and opposite ends, a cylindrical bar located adjacent one end of the base, guide means cooperating with the base and base locating the bar transversely across one end of the base and allowing the bar limited movement relative to the base, endlss belt means having an outer abrasive surface located around the base and bar, and means for moving the bar relative to the base to hold the belt means in tension on te base and bar, said means for moving the bar including a nut mounted on the base open to the one end of the base, a rod threaded through said nut, said base having a passage for the rod, said rod having a first end engageable with said bar and a second end for accommodating a tool used to rotate the rod.

6. The apparatus of claim 5 wherein: said nut is mounted on the mid-section of one end of the base, said bar having a recess facing said nut, said first end of the rod being located in said recess.

7. The apparatus of claim 5 wherein: said belt means has a width greater than the width of the base.

8. A sanding apparatus comprising a rigid base having oposite surfaces and opposite ends, a bar means located adjacent one end of the base, endless belt means having an outer abrasive surface located around the base and bar means, means for moving the bar means relative to the base to hold the belt means in tension on the base and bar means, and guide means cooperating with the bar means and base locating the bar means transversely across the one end of the base and allowing the bar means limited movement relative to the base, said guide means including pin means secured to the base, said bar means being movably mounted on the pin means, said pin means including a pair of pins secured to one end of the base, each pin having an enlarged head, said bar means having counter sunk holes and opposite end portions thereof for the pins and heads whereby the heads of the pins limit movement of the bar means away from one end of the base, said means for moving the bar means including a nut mounted on a center portion of the base open to the one end of the base, said pins being located on opposite sides of the nut, a rod threaded though said nut, said base having a passage for the rod, said rod having a first end engageable with said bar and a second end for accommodating a tool used to rotate the rod.

9. The apparatus of claim 8 wherein: said bar means has a recess in the mid portion thereof facing said nut, said first end of the rod being located in said recess.

10. The apparatus of claim 8 wherein: said belt means has a width greater than the width of the base.

11. A sanding apparatus comprising a rigid base having oposite surfaces and opposite ends, a bar means located adjacent one end of the base, and endless belt means having an outer abrasive surface located around the base and bar means, and means for moving the bar means relative to the base to hold the belt means in tension on the base and bar means, said means for moving the bar means includes nut means mounted on the base open to the one end of the base, rod means threaded through said nut means, said base having passage means for the rod means, said rod means having first end means engageable with said bar means and second end means for accommodating a tool used to rotate said rod means.

12. The apparatus of claim 11 wherein: said nut means is mounted on said one end of the base, said bar means having recess means facing said nut means, said first end means of the rod means being located in said recess means.

13. The apparatus of claim 11 including: pin means secured to said one end of the base, said bar having holes accommodating the pin means whereby said pin means retain the bar adjacent said one end of the base and allow limited movement of the bar relative to the base.

14. The apparatus of claim 11 wherein: said pin means include laterally spaced pins, said bar having a recess between said laterally spaced pins, said first end means of the rod means being located in said recess.

15. The apparatus of claim 11 wherein: said belt means has a width greater than the width of the base.

* * * * *